United States Patent [19]

Sheinberg et al.

[11] Patent Number: 4,942,278

[45] Date of Patent: Jul. 17, 1990

[54] MICROWAVING OF NORMALLY OPAQUE AND SEMI-OPAQUE SUBSTANCES

[75] Inventors: Haskell Sheinberg, Los Alamos, N. Mex.; Thomas T. Meek, Knoxville, Tenn.; Rodger D. Blake, Santa Fe, N. Mex.

[73] Assignee: The United States of America as represented by the United States Department of Energy, Washington, D.C.

[21] Appl. No.: 384,194

[22] Filed: Jul. 24, 1989

Related U.S. Application Data

[62] Division of Ser. No. 281,158, Dec. 5, 1988, Pat. No. 4,857,266.

[51] Int. Cl.[5] ..... H05B 6/64

[52] U.S. Cl. ..... 219/10.55 M; 219/10.55 F; 264/26

[58] Field of Search ..... 219/10.55 M, 10.55 R, 219/10.55 E, 10.55 F; 264/26, 27, 25

[56] References Cited

U.S. PATENT DOCUMENTS

| | | | |
|---|---|---|---|
| 4,307,277 | 12/1981 | Maeda et al. | 219/10.55 R |
| 4,400,604 | 8/1983 | Ohtsuka et al. | 219/10.55 M |
| 4,529,857 | 7/1985 | Meek et al. | 219/10.55 M |
| 4,549,053 | 10/1985 | Haugh | 219/10.55 M |
| 4,617,439 | 10/1986 | Lespinats et al. | 219/10.55 M |
| 4,695,695 | 9/1987 | Meek et al. | 219/10.55 R |

*Primary Examiner*—Philip H. Leung

*Attorney, Agent, or Firm*—Richard J. Cordovano; Paul D. Gaetjens; William R. Moser

[57] ABSTRACT

Method of heating small particles using microwave radiation which are not normally capable of being heated by microwaves. The surfaces of the particles are coated with a material which is transparent to microwave radiation in order to cause microwave coupling to the particles and thus accomplish heating of the particles.

1 Claim, No Drawings

MICROWAVING OF NORMALLY OPAQUE AND SEMI-OPAQUE SUBSTANCES

This invention is the result of a contract with the Department of Energy (Contract No. W-7405-ENG-36).

This is a Division of application Ser. No. 07/281,158 filed 12/05/88, Pat. No. 4,857,266.

BACKGROUND OF THE INVENTION

This invention relates to the arts of powder metallurgy and microwave heating.

Certain metals may be strengthened by adding to them relatively small quantities of particular materials in such a manner that the added materials do not mix with the metal to form a homogenous phase, but are uniformly dispersed in particulate form throughout the metal. The material which is added may be referred to as a dispersoid, while the metal it is dispersed in is referred to as the matrix metal; the combination is known as dispersion-strengthened metal. Oxides make good dispersoids because of their high hardness, stability at high temperatures, insolubility in matrix metals, and availability in fine particulate form.

The present invention was made in connection with the development of dispersion strengthened copper, where the dispersed particles are of copper oxide or copper having a coating of copper oxide. A unique aspect of strengthening copper by means of a dispersed phase, in contrast with the conventional methods of solid solution hardening or precipitation hardening, is that a significant increase in strength is available while retaining a substantially pure metal matrix with very little or virtually no alloying element remaining in solid solution. This has the advantage of giving markedly higher strength without significant loss in electrical or thermal conductivity or in corrosion resistance.

Copper which is dispersion-strengthened with aluminum oxide is commercially available. Prior to the present invention, the use of copper oxide as a dispersoid in copper was unknown.

Additional information may be found in "Dispersion-Strengthened Materials," 7 Powder Metallurgy, 9th Ed., Metals Handbook, American Society for Metals, 710–727 (1984).

SUMMARY OF THE INVENTION

This invention is a composition of matter comprised of copper and particles which are dispersed throughout the copper, where the particles are comprised of copper oxide and copper having a coating of copper oxide, and a method for making this composition of matter.

The method comprises oxidizing at least a portion of copper which is in the form of a powder to form particles, each particle consisting of copper having a thin film of copper oxide on its surface; consolidating said powder and particles to form a workpiece; and exposing said workpiece to microwave radiation in an inert atmosphere until a surface of said workpiece reaches a temperature of at least 500° C.

It is an object of this invention to provide dispersion-strengthened copper in which the dispersoid is copper oxide and a process for making said copper.

It is also an object of this invention to provide a dispersion-strengthening process for copper in which less energy is required in comparison to conventional processes.

It is also an object of this invention to provide a copper dispersion-strengthening process which is less complex and can be accomplished in a shorter time than prior art processes.

It is a further object of this invention to provide a copper dispersion-strengthening process which can be accomplished in an inert gas atmosphere rather than a hydrogen atmosphere.

DETAILED DESCRIPTION OF THE INVENTION

Pure copper powder having a nominal particle size of 1 micron was obtained from Sherritt-Gordon Mines, Ltd. In experimentation on the present invention, copper powder was exposed to the atmosphere in order to form a very thin copper oxide film on at least a portion of the copper particles of the powder. Air penetrates the mass of powder, so that a copper oxide film forms on at least a portion of the particles located in the interior of the mass as well as the exterior. After oxidation, the particles were consolidated into a 1 in. diameter by 1 in. long (2.5 cm×2.5 cm) cylinder by pressing at atmospheric temperature and a pressure of 10,000 psi (68.9 MPa). A binder substance to aid in consolidation was not required. The cold pressed workpiece was then placed in a plastic pressing sack and isostatically pressed at atmospheric temperature and 50,000 psi (344.7 MPa), thereby forming a workpiece having a diameter of slightly less than 1 in. (2.54 cm) and a length of slightly less than one in. (2.5 cm). The density of the workpiece after isostatic pressing was 4.8 g/cm$^3$.

The workpiece was placed in a low density alumina holder which is transparent to microwaves and has a $\frac{1}{8}$ in. (0.3175 cm) diameter aperture, so that the temperature of the workpiece could be determined by means of an infrared optical pyrometer. The holder was placed in a Litton Model 1521 microwave oven and exposed to microwaves at a frequency of 2.45 GHz. The oven was operated at its maximum power of 700 W. During microwaving, an argon-rich atmosphere was maintained within the oven. Though large pieces of copper are opaque to microwaves, fine copper particles couple with 100% of incident microwave radiation. The oxides, cuprous oxide and cupric oxide, couple only partially with microwave radiation at room temperature. However, the copper oxide film has the effect of increasing the effective half power depth of penetration of the composite copper/copper oxide system by the electromagnetic field, resulting in more efficient coupling of the workpiece to the microwave radiation.

The workpiece was microwaved for 35 minutes, reaching a surface temperature of about 650° C. It was held at this temperature for 1 minute and then allowed to cool. The workpiece was cut and polished; the polished surface appeared as an extremely fine grain copper structure with uniform dispersion of very fine particles which, it is believed, were of copper oxide and copper coated with copper oxide. There was a small amount of copper oxide located at the grain boundaries. The microstructure was that of dispersion-strengthened copper. The density of the workpiece was 6.2 g/cm$^3$. Another workpiece was prepared in the same manner and had a density of 6.8 g/cm$^3$.

The electrical resistivities of several workpieces prepared in a similar manner were measured. The resistivities of pressed workpieces before microwaving ranged from about $10^6$ to about $10^8$ ohm-cm. After microwaving, the room temperature resistivities ranged from about 0.01 to about 1 ohm-cm. The oxygen content of the workpieces was from less than 1 to about 10 wt %.

Two different workpieces were tested for strength and hardness; the results are shown in the Table. The Brinnell hardness was determined using a 500 kg load. The Rockwell hardness is based on the E scale.

TABLE

| Sample | Modulus of Elasticity | Ultimate Compressive Strength | Rockwell Hardness | Brinnell Hardness |
|---|---|---|---|---|
| 1 | 12,580,000 psi (86,726 MPa) | 25,159 psi (173.4 MPa) | 70 | 62 |
| 2 | 21,220,000 psi (146,290 MPa) | 52,640 psi (362.9 MPa) | 57 | 55 |

It is expected that the temperature of a workpiece should be raised to at least 500° C. in the practice of this invention and it may be raised to just under the melting point of copper. It may be necessary to use a holding period, at 500° C. or above, of from about 1 minute to about 2 hours. The sizes of the particles dispersed in the workpieces were quite small and ranged up to about 5 microns. Consolidation of the powder after oxidation can be accomplished by means other than pressing, such as extruding. The pressure applied in consolidating a workpiece may range from about 10,000 to about 70,000 psi (68.9–482.6 MPa).

It is expected that the particle sizes of copper powder used as a starting material may range from less than 1 micron up to about 5 or even to 10 microns. Particle sizes mentioned herein are as determined by a Fisher Sub-sieve Sizer. Powder may be defined as consisting of particulate material of small size. It is expected that the microwave radiation used in the practice of this invention will have a frequency of from about 500 MHz to about 500 GHz and be supplied at a power level of from about 50 W to about 1 MW.

As mentioned above, there was copper oxide at the grain boundaries, between the grains, of the workpieces which were cut and polished. The references herein to particles and particulate matter herein are intended to include such copper oxide at the grain boundaries.

In the practice of the present invention, it is believed that it is crucial to condition the surface of at least a portion of the particles of the copper powder. In general, metals, such as copper, are opaque to microwave radiation and will not be heated when subjected to microwaves. However, a metal particle of a sufficiently small size will couple to microwaves and be heated. A particle of sufficiently small size to couple will have a diameter less than or equal to the skin depth for a particular wave length of incident radiation. The depth of penetration of microwave radiation (skin depth) can be calculated from the frequency of the radiation, the magnetic permeability of the metal, and the electrical conductivity of the metal. In the present case, the depth of penetration or electric skin depth of copper is about 1.4 microns; thus, a copper particle having at least one dimension less than 1.4 microns can be heated by microwaves.

However, a mass of powder, even if it has metal particles of sizes less than 1.4 microns, will behave as a solid when subjected to microwave radiation. But, if the surfaces of the particles are conditioned by coating a surface with a substance which is transparent or semi-transparent to microwave radiation, the particles will couple. In the present case, the thin films of copper oxide on at least a portion of the particles of copper powder is substantially transparent and, therefore, facilitates electronic heating of the copper particles. Copper oxide usually consists of cuprous oxide and cupric oxide. These do not couple well with microwave radiation at room temperature, given the low electric field intensity in the microwave oven used in this experimentation, but require much higher temperature before being capable of heating by microwave. For an oven with a higher electric field intensity, they would couple well at low temperatures. The amount of coupling with microwave radiation increases greatly at a temperature of about 500° C. for cuprous oxide and about 600° C. for cupric oxide. Thus, in the practice of the present invention, when heating a workpiece to high temperatures, the copper oxide is heated electronically.

It is emphasized that the present invention does not employ a coupling agent, which is a substance capable of electronic heating. When a coupling agent is used, the agent is heated by microwaves and the heat then flows to another substance not susceptible to microwaves by conduction and, perhaps, convection.

It is expected that the use of microwave radiation to heat substances which are normally opaque to microwaves by conditioning the surfaces of particles of the substances will be useful in numerous applications in addition to the present invention.

The foregoing description of invention has been presented for purposes of illustration and description. It is not intended to be exhaustive or to limit the invention to the precise form disclosed. It is intended that the scope of the invention be defined by the claims appended hereto.

What is claimed is:

1. A method of heating a substance using microwave radiation, where the substance to be heated is not normally capable of being heated by microwave radiation, said method comprising:

a. providing the substance to be heated in the form of small particles;

b. conditioning the surfaces of at least a portion of said small particles by coating each particle surface with a material which is transparent to microwave radiation, thereby facilitating microwave coupling to the substance to be heated and enhancing the effective half power depth of penetration of microwave radiation into the substance to be heated; and c. exposing said substance to microwave radiation.

* * * * *